US005478206A

United States Patent [19]

Prahst

[11] Patent Number: 5,478,206

[45] Date of Patent: Dec. 26, 1995

[54] IMPELLER FOR A RADIAL FAN

[75] Inventor: Eberhard Prahst, Aichwald, Germany

[73] Assignee: Robert Bosch GmbH, Stuttgart, Germany

[21] Appl. No.: 122,431

[22] PCT Filed: Mar. 4, 1992

[86] PCT No.: PCT/DE92/00183

§ 371 Date: Sep. 23, 1993

§ 102(e) Date: Sep. 23, 1993

[87] PCT Pub. No.: WO92/16253

PCT Pub. Date: Jan. 10, 1992

[30] Foreign Application Priority Data

Mar. 23, 1991 [DE] Germany ..... 41 09 646.0

[51] Int. Cl.[6] ..... F04D 29/28

[52] U.S. Cl. ..... 416/186 R; 416/189; 416/241 A

[58] Field of Search ..... 416/182, 183, 416/185, 186 R, 189 R, 223 B, 241 A; 415/200, 915; 264/318, 328.1

[56] References Cited

U.S. PATENT DOCUMENTS

| | | | |
|---|---|---|---|
| 2,301,857 | 11/1942 | Criqui . | |
| 2,399,852 | 5/1946 | Campbell . | |
| 3,782,851 | 1/1974 | Hackbarth . | |
| 4,543,041 | 9/1985 | French et al. | 416/183 |
| 4,566,852 | 1/1986 | Hauser | 416/189 R |

FOREIGN PATENT DOCUMENTS

| | | | |
|---|---|---|---|
| 2335714 | 7/1977 | France . | |
| 204622 | 11/1908 | Germany . | |
| 0005458 | 1/1980 | Japan | 416/183 |
| 0178715 | 11/1982 | Japan | 264/318 |
| 0680040 | 10/1952 | United Kingdom | 416/185 |
| 0696565 | 9/1953 | United Kingdom | 416/186 R |

*Primary Examiner*—Edward K. Look
*Assistant Examiner*—Christopher Verdier
*Attorney, Agent, or Firm*—Michael J. Striker

[57] ABSTRACT

An impeller for a radial fan comprises a hub, a plurality of rotor blades each curved three-dimensionally at least within some areas, each of the rotor blades having a center part which extends substantially straight and radially from the hub, a curved primary part into which the center part merges tangentially and which extends in a radial direction around an axis extending substantially perpendicular to an impeller rotary axis, and a secondary part in which the center part merges tangentially in a radial direction and which is curved about an axis extending parallel to the impeller rotary axis and a guide ring located at an inflow region of the rotor blades. The impeller can have a frame, and an additional guide ring arranged at the axial distance from the guide ring and rigidly arranged with respect to the frame. The center part of the impeller can extend within a plane which is inclined at an angle to a radial line passing through the inner periphery of the center part.

15 Claims, 3 Drawing Sheets

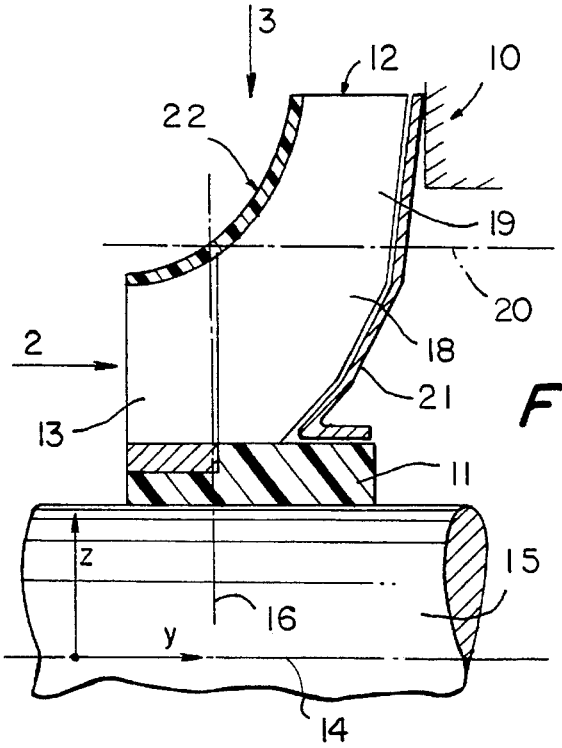
FIG. 6
FIG. 7
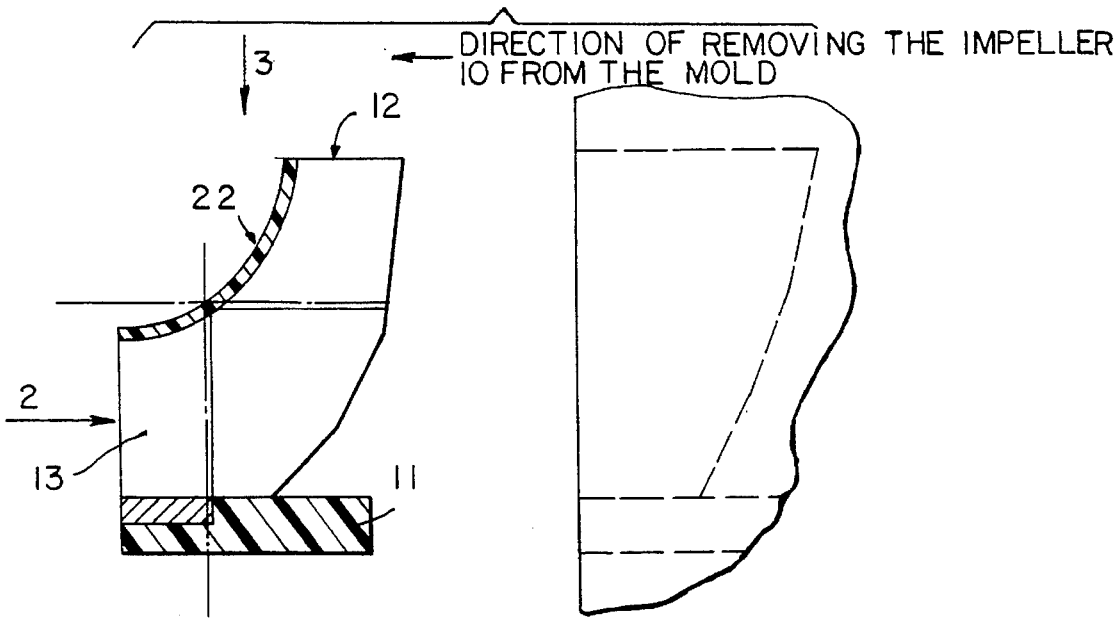

IMPELLER FOR A RADIAL FAN

BACKGROUND OF THE INVENTION

The present invention relates to an impeller for a radial fan, and in particular, for electric motor-driven hand-held machine tools or the like electric tool. Impellers of this type, in which the rotor blades are curved in a two-dimensional manner, are known. Although costly to produce such impellers have the disadvantage of low output.

SUMMARY OF THE INVENTION

Accordingly, it is an object of the present invention to provide an impeller for a radial fan, which avoids the disadvantages of the prior art.

In keeping with these objects and with others which will become apparent hereinafter, one feature of the present invention resides, briefly stated, in an impeller for a radial fan, which has a hub with a plurality of rotor blades wherein in accordance with the present invention every rotor blade is constructed so as to be curved three-dimensionally, at least within some areas.

When the impeller for a radial fan is designed in accordance with the present invention, it has the advantage over the prior art that a higher output in addition to a greater air throughput, improved efficiency, reduced noise, and reduced blade wear due to abrasive dust can be achieved within the same constructional space.

In accordance with another feature of the present invention every rotor blade of the impeller has a primary part located in an inflow region and curved in various ways, a center part connected to the primary part and forming a surface which is as uniform and free of gaps as possible, and a secondary part which is also curved in certain ways.

In accordance with a further feature of the present invention a guide ring adjoining the rotor blades can be provided and formed for example of one piece with the rotor blades.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 6 and 7 show a guide ring associated with the impeller blades.

DESCRIPTION OF THE PREFERRED EMBODIMENTS

Figure 1:
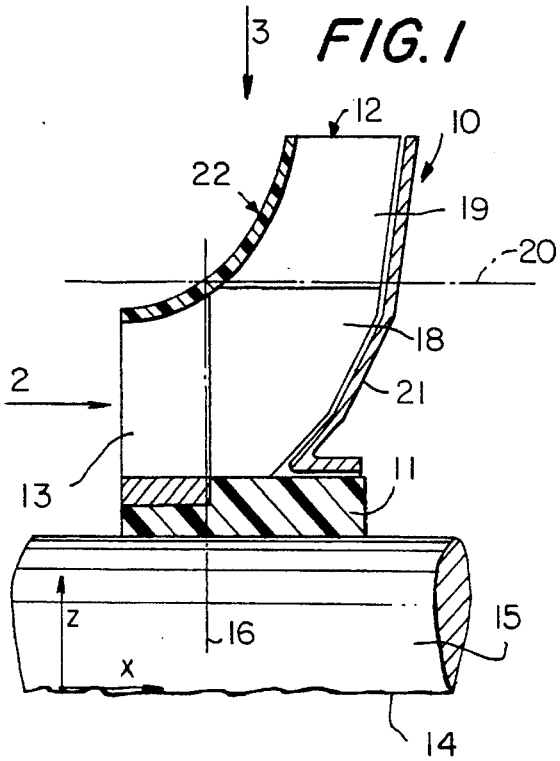
FIG. 1 shows a schematic side view in partial section of a part of an impeller for a radial fan.
Figure 2:
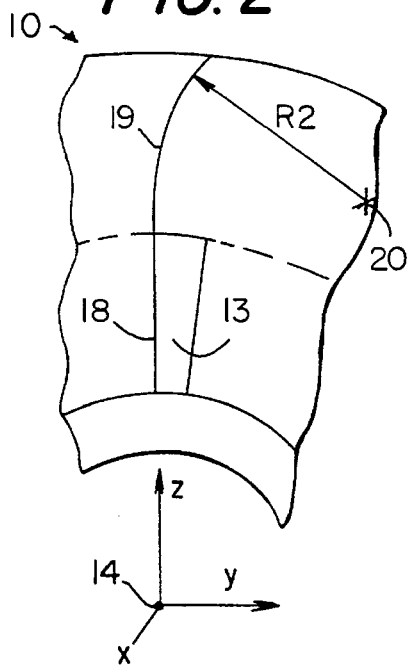
FIGS. 2 and 3, respectively, show a schematic view of a part of the impeller in arrow directions II and III in FIG. 1.

FIG. 1 is a schematic view of an impeller 10 suitable for a radial fan, radial blower or the like and particularly for fans for electric motor-driven hand-held tools or the like electric tools. The impeller 10 serves, fore example, to cool the motor, as a dust exhaust or the like. In particular, the impeller 10 has a hub 11 and a plurality of rotor blades 12.

The rotor blades 12 are curved three-dimensionally at least within some areas. Consequently, compared to known blades which are curved in two dimensions, a greater air throughput, decreased noise, reduced blade wear due to abrasive dust or the like, improved efficiency, reduced constructional volume, and reduced expenditure on manufacture, in particular lower production costs, are achieved.

Figure 3:
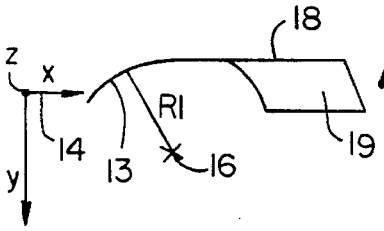
Figure 4:
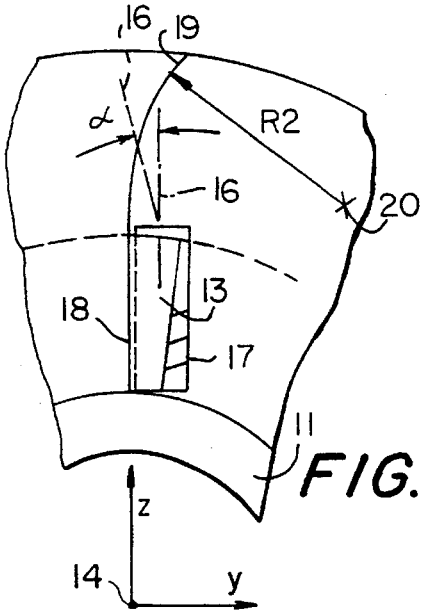
FIGS. 4 and 5, respectively, show a schematic view of a part of the impeller roughly corresponding to that shown in FIG. 2 in different constructions.

Details of the curvature of the rotor blades 12 which is three-dimensional at least within some areas are described in the following. Each rotor blade 12 has a primary part 13 located in the inflow region. This primary part 13 is curved to the left or to the right as considered in direction of rotation, at least partially, out of a diametrical plane, where the radius of curvature of the blade is R1 for example. The impeller 10 can be fastened by its hub 11 to a shaft 15, e.g. of an electric motor, a hand-held machine tool or the like, and the longitudinal center axis 14 of the shaft 15 coincides, for example with the X axis of a coordinate system having three axes X, Y and Z. The primary part 13 can curved at a radius R1 around an axis which is directed approximately radially with reference to the longitudinal center axis 14. In the embodiment example shown in FIGS. 3 and 4, the primary part 13 is curved with radius R1 around an axis 16 which extends approximately parallel to the radial line z or, as shown in dashed lines in FIG. 4, can extend at an angle $\alpha$ relative to the radial line z. Exclusively for the sake of a clearer understanding of the invention, FIG. 4 shows schematically a cuter 17 whose axis extends in the direction of axis 16 and serves to show the course of the blade curvature with radius R1 in the primary part 13 and e.g. the manner in which it can be produced. The axis of the cutter 17 can extend either parallel to the radial line z or at an angle $\alpha$ relative to the radial line z corresponding to the dashed line in FIG. 4.

Figure 5:
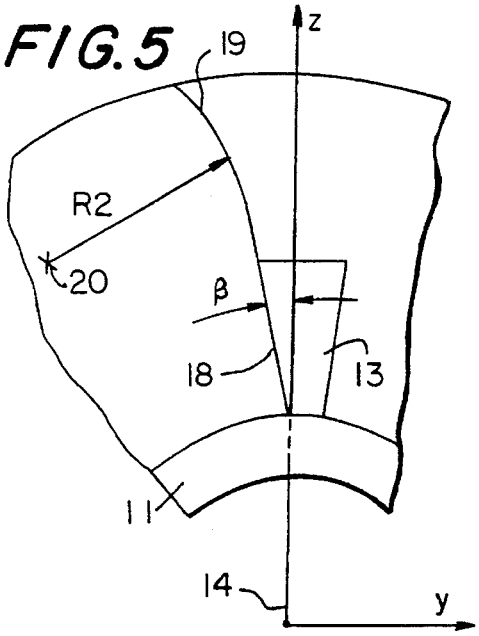
Figure 8:
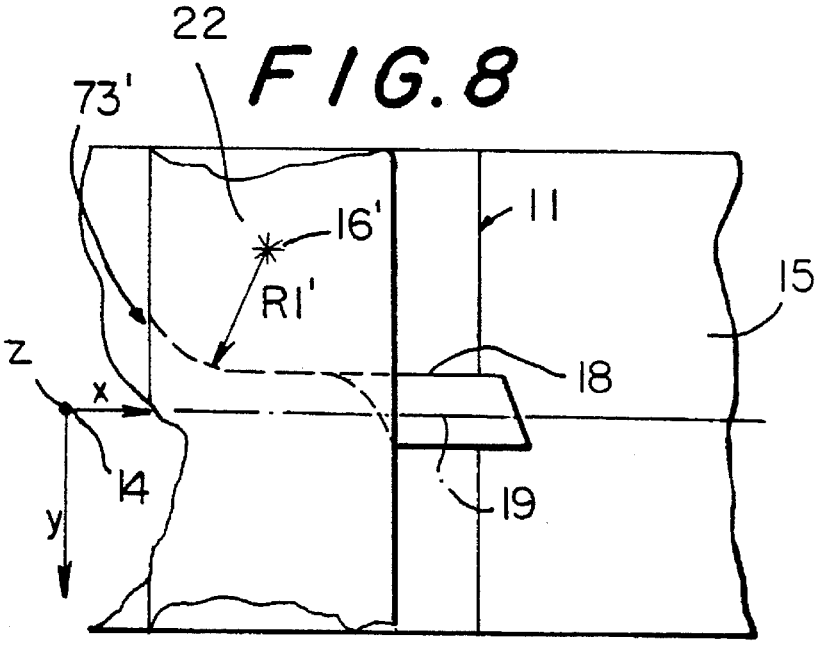
FIGS. 8 and 9 are views showing further details of the inventive impeller.
Figure 9:
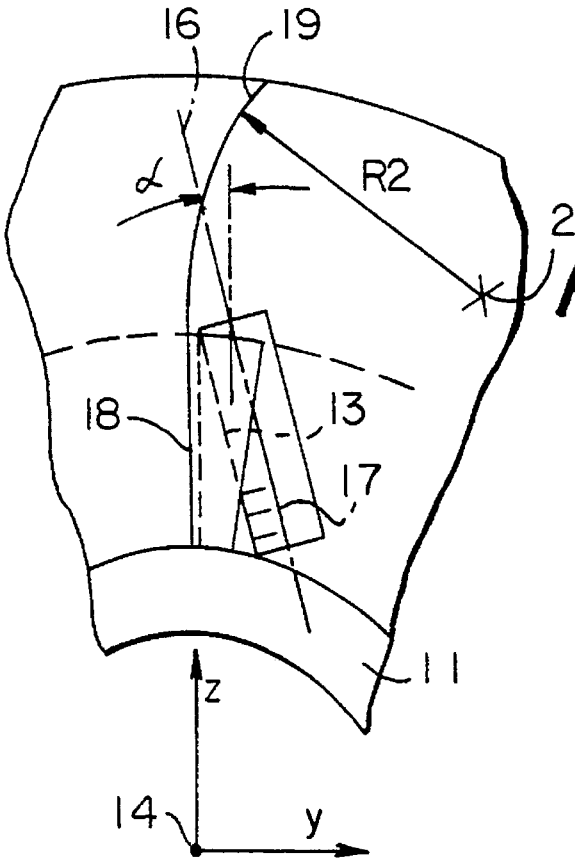

Further, every rotor blade 12 has a center part 18 adjoining the primary part 13 so as to form a surface which is as uniform and free of gaps as possible. The center part 18 adjoins the primary part 13 at least substantially in the axial direction, the center part 18 extending at least approximately radially. FIG. 5 shows that the center part 18, in contrast to the embodiment example according to FIGS. 1 and 4, can alternatively also extend within a plane which is inclined relative to the radial line z at an angle $\beta$ in either circumferential direction. In the example according to FIGS. 1 to 4, the center part 18 accordingly extends within the X-Z plane, whereas in the example according to FIG. 5 it extends so as to inclined thereto at an angle $\beta$.

Further, each rotor blade 12 has a secondary part 19 which adjoins the center part 18 at least predominantly in the radial direction while forming a surface at the center part 18 which is as uniform and free of gaps as possible. The primary part 13 forms a primary fan. The secondary part 19 forms a secondary fan. The curvature of the primary part 13 with radius R1 results in a smooth or shockless entrance of air. The secondary part 19 is at least partially curved forward or backward out of a diametrical plane, this curvature having a radius R2. The secondary part 19 is curved around an axis 20 which is aligned at least approximately parallel to the longitudinal center axis 14.

The primary part 13, the center part 18 and the secondary part 19 contact one another and are joined so as to form a surface which is as uniform and free of gaps as possible. This is the case when these parts are produced from individual members and are joined in an appropriate manner, resulting also in the abutment lines in the region of joining shown in FIG. 1. Alternatively, the primary part 13, the center part 18 and the secondary part 19 can also form one piece, particularly when the impeller 10 is manufactured in series production. It will be noted that the supporting disk provided in conventional impellers is dispensed with in the impeller 10. A guide ring 21 which is associated with the impeller 10 and rigidly arranged with respect to the frame assumes the task of guiding the flow. The impeller 10 can have, at an axial distance from the guide ring 21, a guide ring or similar ring 22 which adjoins the individual rotor blades 12 radially at the outside, preferably forms one piece with the latter, and serves to guide the flow from the inflow region to the radial outflow region. The entire impeller 10 can be designed as a plastic injection molded part forming one piece, in which the rotor blades 12 and the guide ring 22 and/or the hub 11 together form one piece. The plastic injection molded part is removed from the injection mold in the axial direction, e.g. in the direction of the longitudinal center axis 14. This makes it possible to dispense with the supporting disk conventionally used in impellers.

The impeller 10 has the following advantages compared with the previously known impellers with two-dimensional blade curvature: higher output in addition to a greater air throughput, improved efficiency, reduced noise, and reduced blade wear due to abrasive dust are provided within the same constructional space.

It will be understood that each of the elements described above, or two or more together, may also find a useful application in other types of constructions differing from the types described above.

While the invention has been illustrated and described as embodied in an impeller for a radial fan, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An impeller for a radial fan, comprising a hub; a plurality of rotor blades each curved three-dimensionally at least within some areas, each of said rotor blades having a center part which extends substantially straight and radially from said hub, a curved primary part into which said center part merges tangentially and which extends in a radial direction around an axis extending substantially perpendicular to an impeller rotary axis, and a secondary part in which said center part merges tangentially in a radial direction and which is curved about an axis extending parallel to the impeller rotary axis; and a guide ring located at an inflow region of said rotor blades, said center part extending within a plane which is inclined at an angle to a radial line, said radial line passing through the inner periphery of said center part.

2. An impeller as defined in claim 1, wherein said primary part is located in an inflow region and curved at least partially out of a diametrical plane.

3. An impeller as defined in claim 2, wherein said axis around which said primary part of each of said rotor blades is curved is an axis extending approximately parallel to a radial line.

4. An impeller as defined in claim 2, wherein said axis around which said primary part of each of said rotor blades is curved is an axis extending approximately at an angle to a radial line.

5. An impeller as defined in claim 2, wherein said axis around which said primary part of each of said rotor blades is curved is an approximately radially directed axis.

6. An impeller as defined in claim 1, wherein said center part is connected to said primary part so as to form a surface which is substantially uniform and free of gaps.

7. An impeller as defined in claim 1, wherein said secondary part is at least partially curved out of a diametrical plane.

8. An impeller as defined in claim 1, wherein said primary part, said center part and said secondary part contact one another and are joined so as to form a continuous surface which is free of gaps.

9. An impeller as defined in claim 1, wherein said primary part, said center part and said secondary part contact one another and are joined so as to form with one another a one-piece element.

10. An impeller as defined in claim 1, wherein said guide ring is formed of one piece with said rotor blades.

11. An impeller as defined in claim 1 wherein said rotor blades, said guide ring and said hub together form a one-piece plastic injection molded part.

12. An impeller as defined in claim 11, wherein said one-piece plastic injected molded part is formed so that is removable from a mold in direction of the impeller rotary axis.

13. An impeller as defined in claim 1, wherein said guide ring is formed as an additional flow guiding element.

14. An impeller as defined in claim 1, wherein each of said blades including said center part, said primary part and said secondary part is formed as a one-piece member.

15. An impeller for a radial fan, comprising a hub; a plurality of rotor blades each curved three-dimensionally at least within some areas, each of said rotor blades having a center part which extends substantially straight and radially from said hub, a curved primary part into which said center part merges tangentially and which extends in a radial direction around an axis extending substantially perpendicular to an impeller rotary axis, and a secondary part in which said center part merges tangentially in a radial direction and which is curved about an axis extending parallel to the impeller rotary axis; a guide ring located at an inflow region of said rotor blades; a frame; and an additional guide arranged at an axial distance from said guide ring and rigidly arranged with respect to said frame.

* * * * *